US008403163B2

(12) United States Patent
Spann et al.

(10) Patent No.: US 8,403,163 B2
(45) Date of Patent: Mar. 26, 2013

(54) PROTECTION AND CONTAINMENT SYSTEM FOR CO-PACKAGED CONTAINERS

(75) Inventors: Herbert H. Spann, Lincoln, NE (US); Darrell A. Oltman, Lincoln, NE (US)

(73) Assignee: Snyder Industries, Inc., Lincoln, NE (US)

( * ) Notice: Subject to any disclaimer, the term of this patent is extended or adjusted under 35 U.S.C. 154(b) by 224 days.

(21) Appl. No.: 12/914,479

(22) Filed: Oct. 28, 2010

(65) Prior Publication Data

US 2011/0100869 A1 May 5, 2011

Related U.S. Application Data

(60) Provisional application No. 61/258,031, filed on Nov. 4, 2009.

(51) Int. Cl.
*B65D 21/02* (2006.01)
*B65D 85/30* (2006.01)

(52) U.S. Cl. ..... 220/23.83; 220/23.88; 206/585; 206/501; 206/509

(58) Field of Classification Search ..... 206/585, 206/599, 488, 486, 501, 514, 512, 821, 386, 206/495, 499, 503, 505, 509; 220/1.5, 1.6, 220/23.89, 23.83, 23.88, 521, 23.91, 23.87, 220/4.27, 4.26, 23.86
See application file for complete search history.

(56) References Cited

U.S. PATENT DOCUMENTS

| | | | | |
|---|---|---|---|---|
| 4,372,523 | A * | 2/1983 | McCartney | 249/79 |
| 5,197,601 | A * | 3/1993 | Sterett | 206/511 |
| 5,415,286 | A * | 5/1995 | Marchek et al. | 206/722 |
| 5,423,428 | A * | 6/1995 | Selz | 206/597 |
| 5,430,927 | A | 7/1995 | Rogers | |
| 5,490,603 | A * | 2/1996 | Davis | 220/4.12 |
| 5,651,463 | A * | 7/1997 | Major et al. | 206/599 |
| 5,722,552 | A * | 3/1998 | Olson | 220/9.2 |
| 6,079,580 | A * | 6/2000 | Garton et al. | 220/1.5 |
| 6,193,099 | B1 | 2/2001 | Garton et al. | |
| 6,247,594 | B1 * | 6/2001 | Garton | 206/512 |
| 6,474,496 | B1 | 11/2002 | Garton | |
| 6,484,899 | B1 | 11/2002 | Garton | |
| 7,090,078 | B2 * | 8/2006 | Gits | 206/386 |
| 7,111,561 | B2 * | 9/2006 | Kulbeth et al. | 108/51.11 |
| 2001/0038011 | A1 * | 11/2001 | Hillis | 220/6 |

* cited by examiner

*Primary Examiner* — Steven A. Reynolds
(74) *Attorney, Agent, or Firm* — Hovey Williams LLP

(57) ABSTRACT

A protection and containment system for co-packaged containers is provided which includes a hollow primary container, a top protector complementally configure to fit atop the primary container, and at least one retainer coupled to the top protector for holding a secondary container. The primary container has a circumscribing upright sidewall and an opening configured for receiving material to be stored in the container. The top protector includes a side wall and at least a pair of spaced-apart opposed risers, most preferably provided as one of four corner modules, the risers extending upwardly from the primary container above the opening and presenting a gap between the risers which is sized and configured for receiving the secondary container. Several retainers can be provided, either to hold the secondary containers in different gaps, or provided in tandem to hold two secondary containers adjacent to one another in or proximate a single gap.

15 Claims, 11 Drawing Sheets

PROTECTION AND CONTAINMENT SYSTEM FOR CO-PACKAGED CONTAINERS

BACKGROUND OF THE INVENTION

1. Field of the Invention

This invention concerns a system for storage and transportation of containers where a primary container system is adapted for mounting one or more secondary containers in a secured and protected condition. More particularly, it is concerned with a protection and containment system whereby the secondary containers can be stored and transported in combination with the primary container, and the system can be stacked atop a similarly configured protection and containment system.

2. Description of the Prior Art

It is often necessary to store chemicals in liquid and dry form in containers. Small containers in a variety of different configurations have been developed from which chemicals can poured for use, and also larger containers from which the chemicals can be dispensed through gravity feed or pumping. One type of container which has heretofore been used for the storage and transport of chemicals is called an intermediate bulk container. During storage, it is often desirable to provide outlets through which selected quantities of the contents can be obtained for use. Often, the contents are dispensed from the containers through gravity feed, or alternatively pumps can be mounted to the container for pumping the contents for use. Also, it is often desirable to stack the containers during transport and storage.

Various types of apparatus for storage of liquids and dry materials have heretofore been developed. Examples of such apparatus include those shown in U.S. Pat. Nos. 5,430,927, 5,490,603, 6,079,580, 6,193,099, 6,247,594, 6,474,496 and 6,484,899, the entire disclosures of which are incorporated herein by reference. However, these systems are designed for use with a single container. In some instances, two or more chemicals in liquid or dry (e.g., powder, granular, etc.) form need to be stored separately and then mixed or otherwise combined at or near the time of use.

Thus, a need has developed for a system whereby containers can be securely stored and transported in a single system.

SUMMARY OF THE INVENTION

The present invention provides a system which facilitates the transportation and storage of a primary container in combination with one or more secondary containers in a single, economical, stackable arrangement. That is to say, the present system presents a significant advance in handling, transporting and storing chemicals where secondary containers are protected and stored in a system housing a primary container.

The system hereof broadly includes a base, a primary container nested into the base, and a top protector configured and arranged for mounting on top of the primary container, wherein the top protector is provided with a retainer and complementally configured with the primary container to receive one or more secondary containers in a nested configuration. The top protector is configured to receive a base of the same or similar configuration in stacked relationship on the top protector. Thus, a plurality of such systems in accordance with the present invention, each including the primary container and the secondary containers, can be stored and transported in stacked arrangement, thereby reducing the floor space necessary for storing a plurality of such systems.

Advantageously, the system is integrated such that the base, primary container, top protector and secondary containers all contribute to the stability and support of the system. This is particularly beneficial in transportation situations to inhibit relatively movement between the components of the system and to maintain the integrity of the system during dynamic conditions. In this regard, the top protector is preferably configured with a plurality of corner sections sized and arranged to support the base thereon, with connecting walls between the corner sections. A retainer is preferably provided to hold the secondary containers in nested positions between the corner sections, or alternatively in side by side arrangement extending into the interior of the top protector which is surrounded by the corner sections and connecting walls. The retainer can be integrally formed with the top protector, or more preferably provided as a separate member removably mounted to the top protector. The secondary containers may be bottles, jugs or the like of various sizes, and can include both containers which are substantially rigid as well as containers which are flexible such as bags which can contain liquid or dry ingredients such as those in granular, powder, pellet or other dry forms.

These and other advantages will be readily appreciated by those skilled in the art with reference to the drawings and detailed description which follows.

DESCRIPTION OF THE PREFERRED EMBODIMENT

Figure 1:
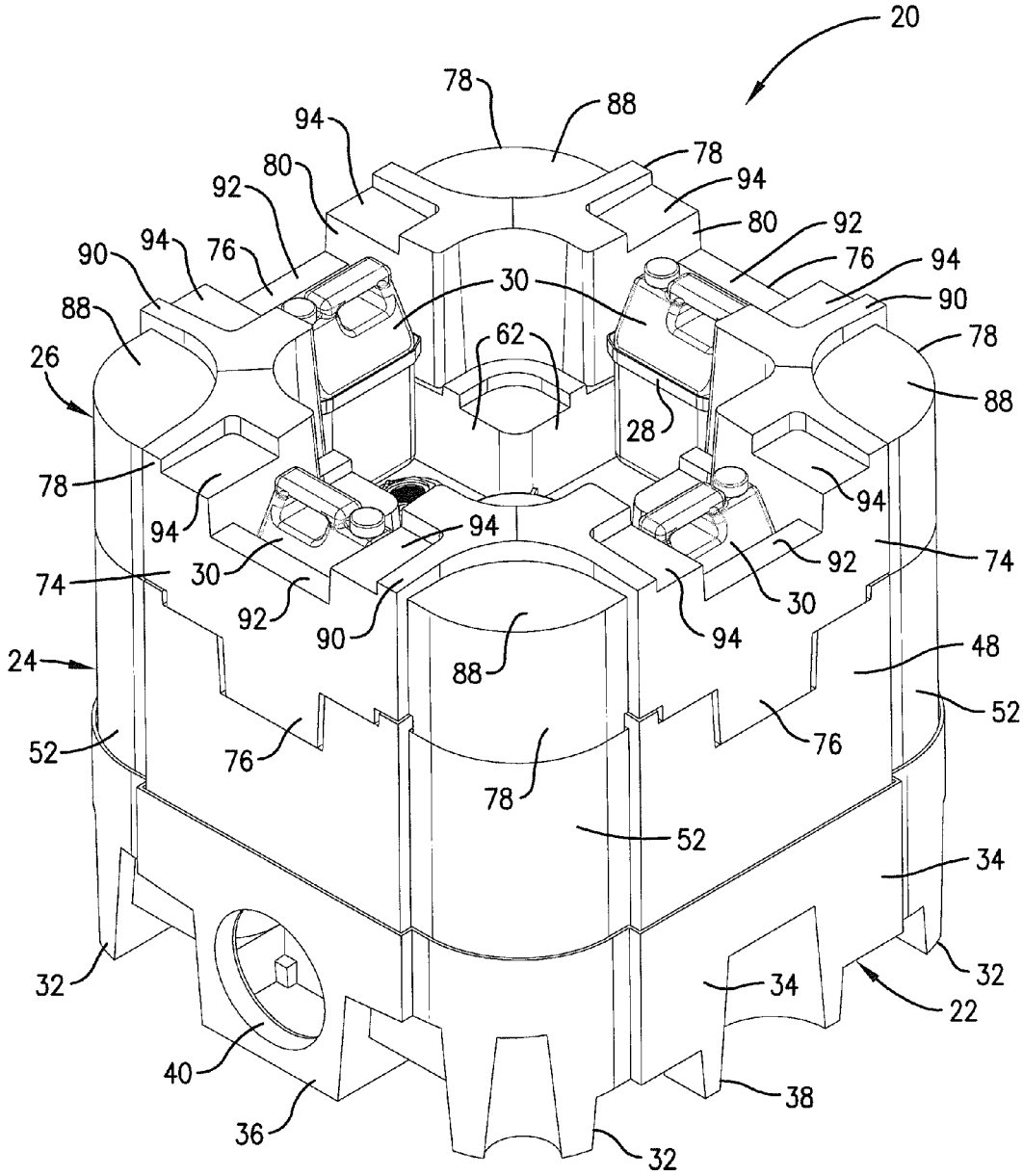
FIG. 1 is an isometric view of a protection and containment system for co-packaged containers in accordance with the present invention, showing a base, a primary container atop the base, a top protector mounted on the primary container, and a plurality of secondary containers nested in the top protector atop the primary container and held by retainers.
Figure 2:
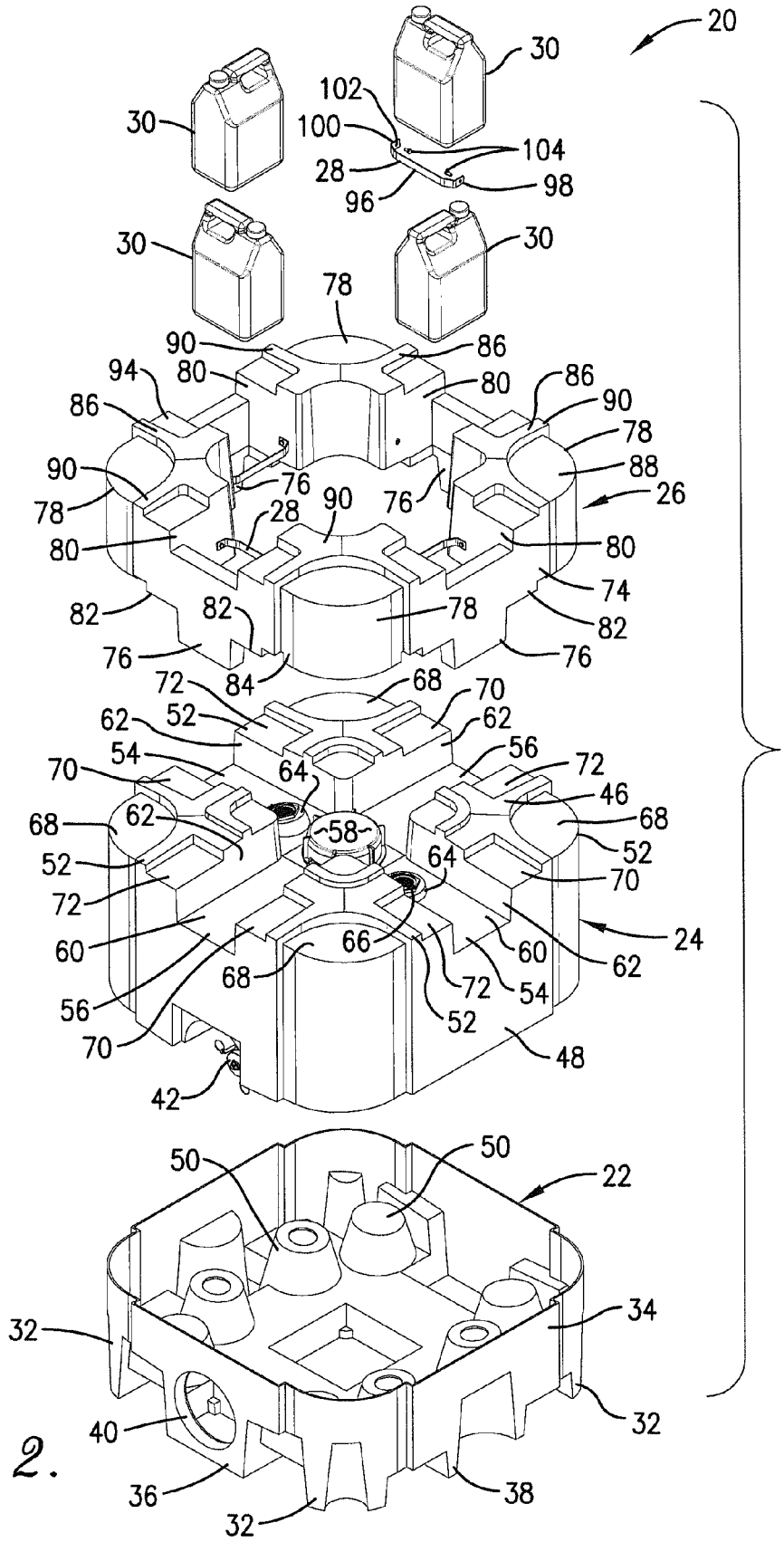
FIG. 2 is an exploded isometric view of the invention shown in FIG. 1, showing the base, the primary container including its inlet and outlet, the top protector, and the secondary containers, with one of the retainers removed.
Figure 3:
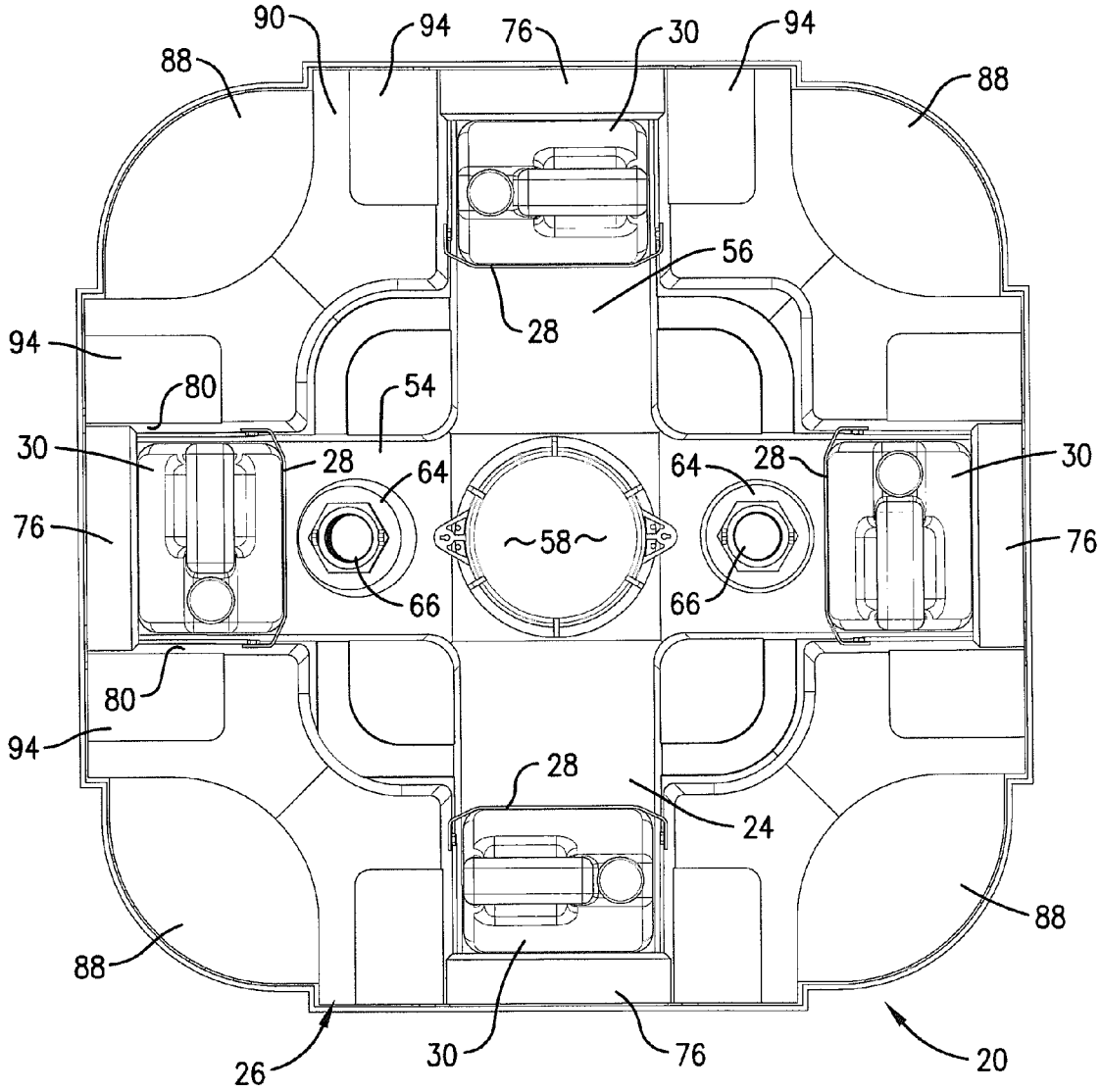
FIG. 3 is a top plan view, showing the nested position of the secondary containers within the top protector.

Referring now to the drawing, a protection and containment system for co-packaged containers 20 broadly includes a base 22, a primary container 24, and a top protector 26 which includes a retainer 28 for retaining at least one secondary container 30. The primary container 24 and secondary containers 30 may be used to hold chemicals in liquid or dry form. The base 22 is complementally configured with the primary container 24 so that the primary container 24 rests atop and is supported by the base 22 and is at least partially received therein. Similarly, the top protector 26 is complementally configured to mount on top of the primary container 24 and mate therewith.

In greater detail, the base 22 may be rotationally molded of synthetic resin such as high density polyethylene (HDPE) and is configured with legs 32 preferably located to extend downwardly at the corners of a generally rectangularly configured sidewall 34. In addition, opposed stands 36 extend downwardly from the sidewall 34 between the legs 32 along two sides of the sidewall 34, and feet 38 extend downwardly on the alternative two sides of the sidewall 34. One of the stands 36 preferably includes an opening 40 for access to a tubular extension of the primary container 24 on which an outlet valve 42 may be mounted.

Figure 4:
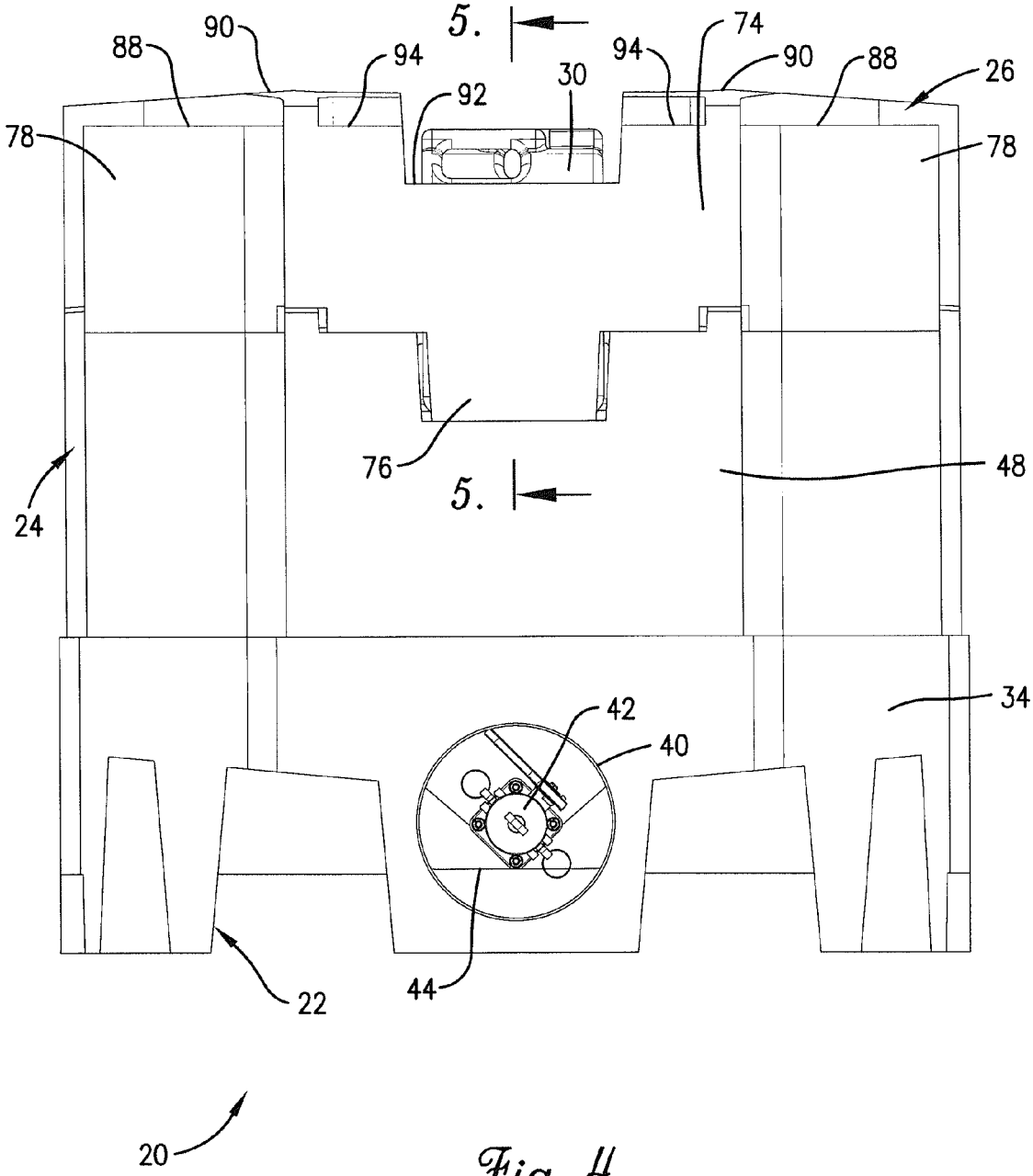
FIG. 4 is a front elevation view, showing how the top protector extends above the top of both the primary container and the secondary containers.

The primary container 24 is preferably rotationally molded of HDPE and is hollow to receive a chemical, most typically a liquid chemical, therein. The primary container 24 preferably includes a bottom wall 44 (seen in FIG. 4 through opening 40), a top wall 46 and a surrounding sidewall 48. The sidewall 48 is configured complemental with the sidewall 34 of the base 22, and the bottom wall 44 is configured complemental with the base 22 so that the primary container 24 nests with the base and is at least partially received therein, with the bottom wall 44 supported, at least in part, on projections 50 molded into the base 22. The top wall 46 is configured with four corner sections 52 which are separated by presents a pair of intersecting channels 54 and 56. An inlet opening having a cap 58 is located at the intersection of the channels 54 and 56. Each of the channels 54 and 56 preferably includes a preferably substantially planar floor 60 and a pair of opposed, upright channel walls 62. In addition, access ports 64 with closures 66 may be provided along the planar floor 60. The corner sections 52 preferably include corner shelves 68 and side shelves 70 and 72.

The top protector 26 is configured to be complemental with the primary container 24 so as to fit therewith. In that regard, the top protector includes side walls 74 each having a downwardly extending lug 76 for receipt into the channels, the bottom surface of the lugs 76 being sized and configured to sit in the channels and rest on the planar floors 60. The lugs 76 are unitary with and connect corner modules 78. The corner modules 78 preferably include upright, generally planar risers 80, configured such that two risers 80 of any corner module 78 are generally perpendicular to one another and each riser 80 of a corner module 78 is generally parallel to and opposite another riser 80 of an adjacent corner module 78 to which it is connected by a lug 76. As seen in FIG. 1, the opposed risers 80 are spaced apart by the width of the lug 76 connecting the respective two corner modules 78 and thus present a gap between the risers. Shoulder 82 extend laterally from each side of the lugs 76 and are sized and configured to rest on respective ones of the side shelves 70 and 72. Each corner module 78 also includes a downwardly extending corner foot 84 which is complementally configured to rest on and be supported by the corner shelf 68 of the primary container 24. The corner modules 78 also include a top surface 86 which includes a substantially planar corner deck 88 which is configured complemental with the legs 32 so that the legs are supported on the corner deck 88 when one system 20 is stacked atop another system 20. The top surface 86 also includes an upwardly extending rim 90 which projects upwardly above the corner deck 88. The rim 90 also projects above the top edge 92 of the lugs 76 and above side decks 94 which are sized and positioned to receive the stands 36 and feet 38 of a base 22 when the base 22 is stacked on the top protector 26.

Figure 11:
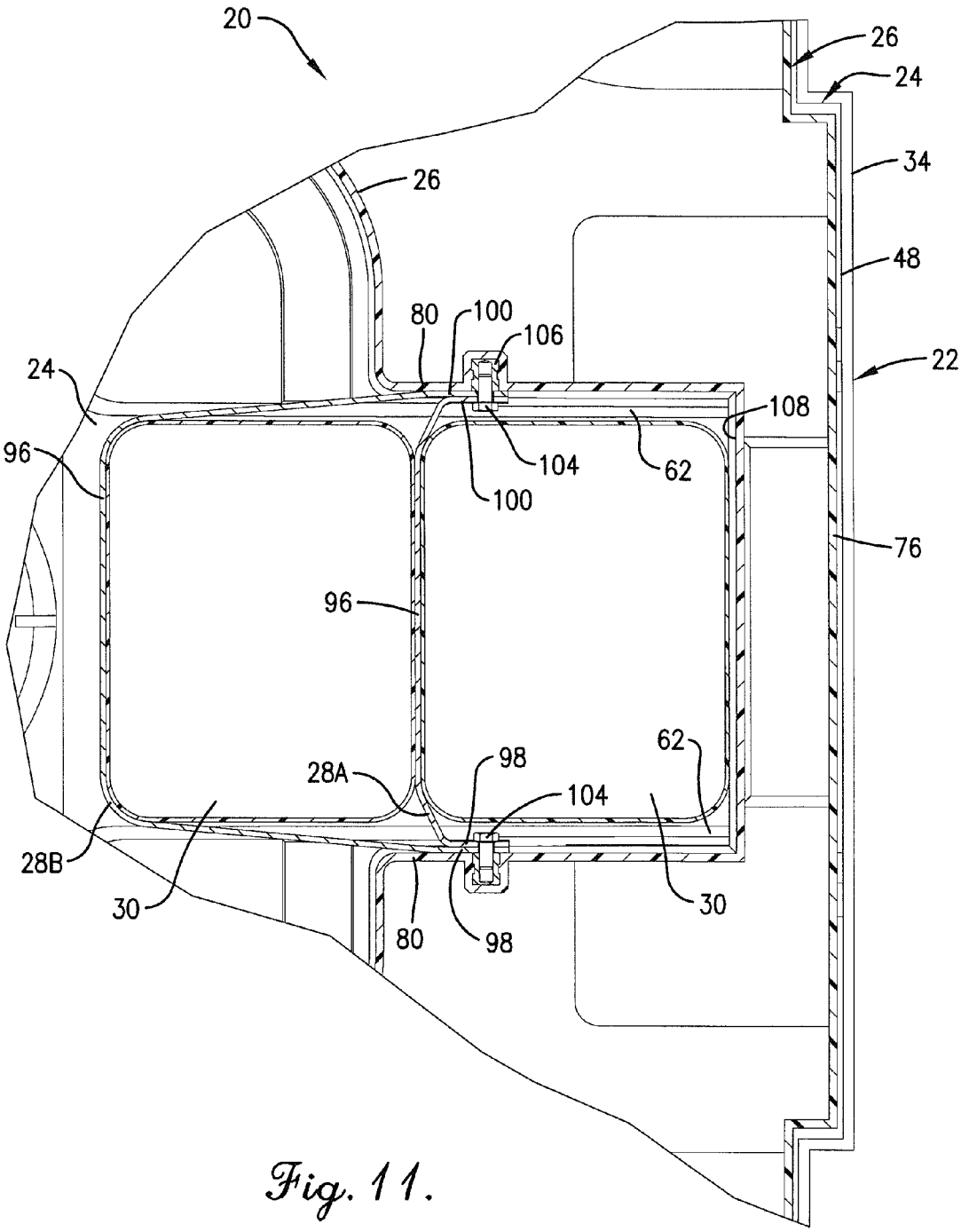
FIG. 11 is an enlarged horizontal cross-sectional view taken along line 11-11 of FIG. 10, and showing the arrangements of the retainer and secondary containers between the corner sections.

The retainers 28 may be provided of metal, nylon or other synthetic resin material, but more preferably are made of an elastomeric material such as, for example, natural or synthetic rubber or other synthetic resin material. The retainers 28 when mounted to the corner modules 78 have an elongated bight 96 and a pair of ends 98 and 100. Each of the ends 98 and 100 is configured for mounting to the corner modules 78. While this may be accomplished in various ways, such as by mounting lugs molded into the corner modules with complemental attachment receivers on the retainers, as shown in the drawings the ends 98 and 100 each have holes 102 and are temporarily attached by bolts 104 threaded into metal anchors 106 molded into the risers 80 of the corner modules 78. Alternatively, the retainers 28 may be coupled directly to the top protector 26 using threaded fasteners, such as double-pitched self-tapping screws. As may be seen in FIG. 11, two retainers 28A and 28B are provided, both being fastened to the same anchor 106 by a respective bolt 104, but with the retainer 28B being a strap of greater length than the retainer 28A.

The secondary containers 30 have a smaller in volume than the primary container 24 and are configured so that several such secondary containers 30 may be nested into the top protector 26 in the gap between opposed risers 80. The secondary containers 30 are typically synthetic resin jugs for containing liquid or dry chemical materials, and preferably have a height which, when the system 20 is assembled and the secondary container 30 is positioned resting atop the planar floor 60 and between opposed risers 80, no part of the secondary containers 30 extend upwardly beyond the rim 90. The secondary containers 30 when held by the retainers rest between two opposed risers 80 and against an interior surface 108 of a lug 76 or against another secondary container 30 as shown in the drawings.

Figure 5:
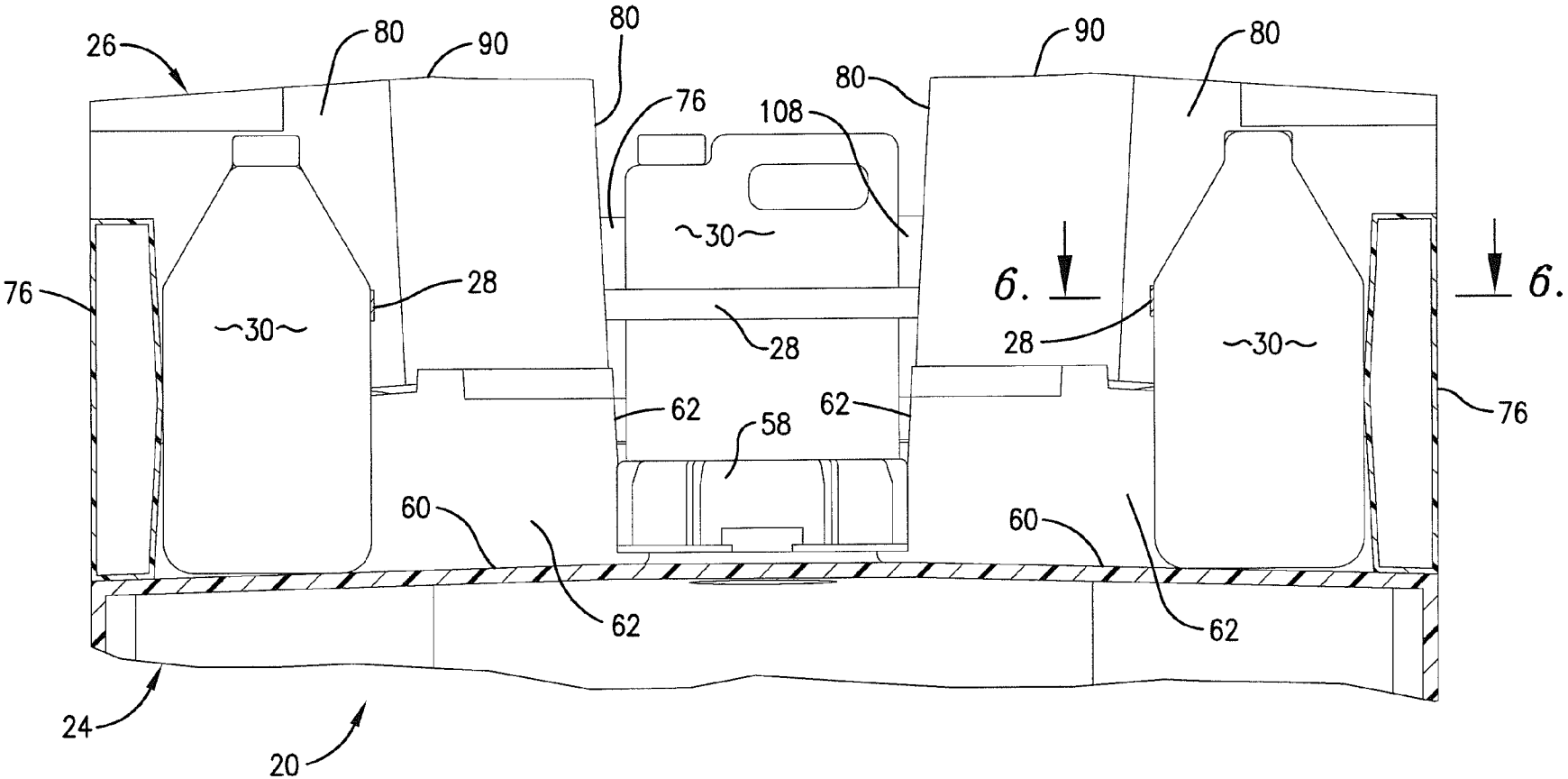
FIG. 5 is an enlarged vertical cross-sectional view taken along line 5-5 of FIG. 4, showing the positioning of the secondary containers and the support shelves in the top protector for receiving another base thereon.
Figure 6:
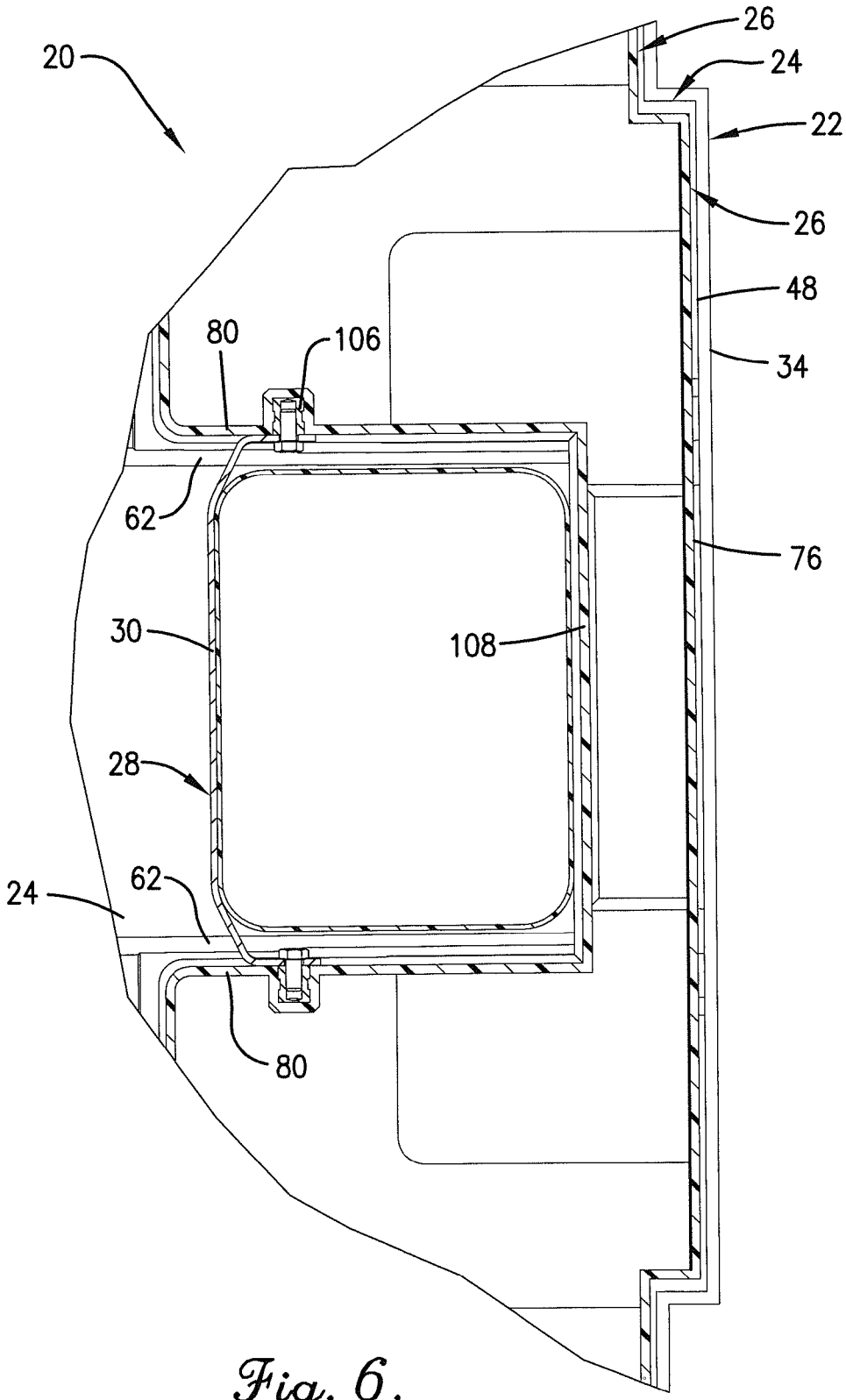
FIG. 6 is an enlarged, horizontal cross-sectional view taken along line 6-6 of FIG. 5, showing an anchor for mounting the retainer embedded in the wall of adjacent corner sections of the top protector.
Figure 7:
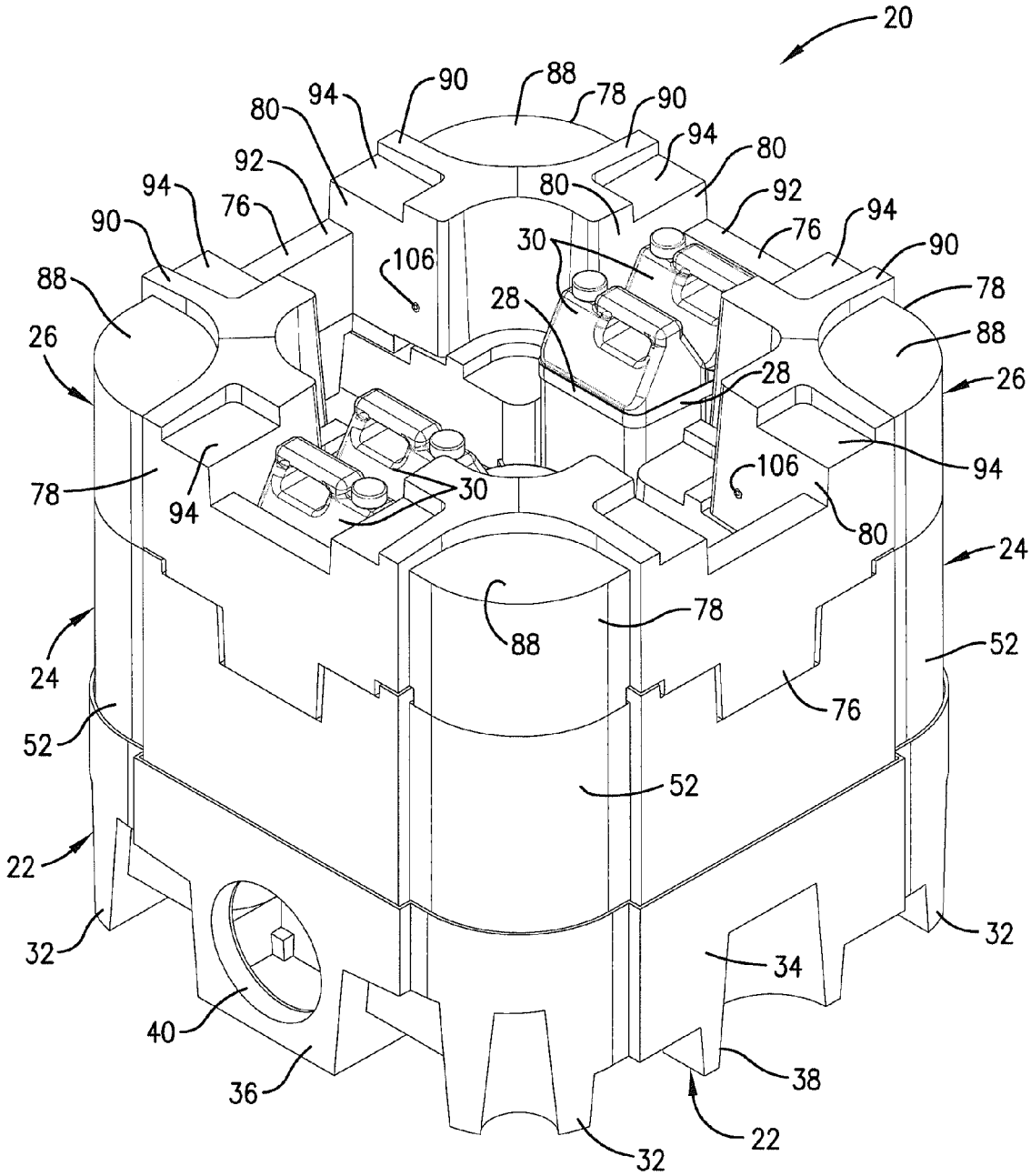
FIG. 7 is an isometric view of the system hereof wherein the retainer includes an additional strap and is thereby configured to hold a plurality of secondary containers.
Figure 8:
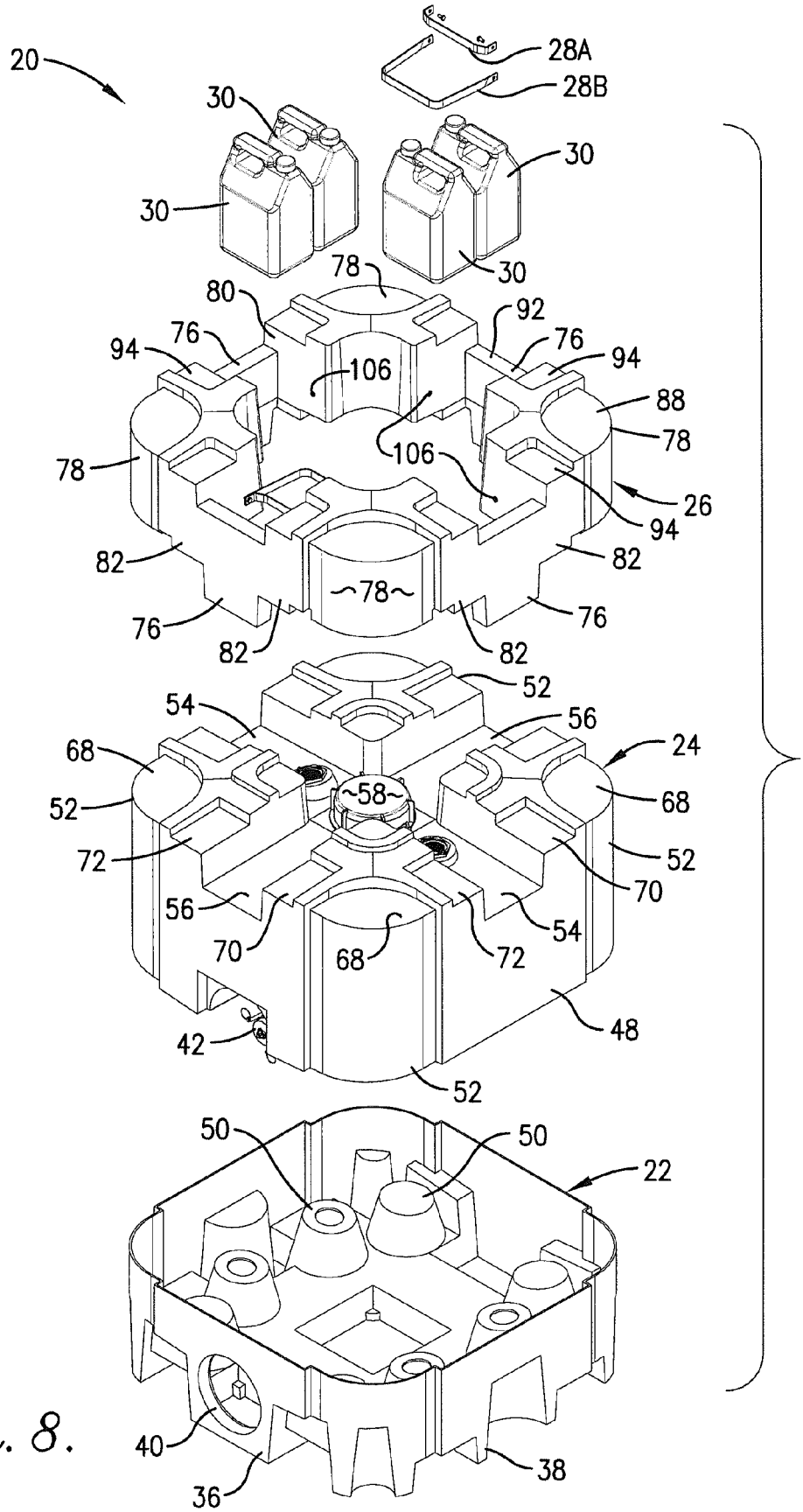
FIG. 8 is an exploded view of the arrangement of FIG. 7 similar to FIG. 2, showing one of the retainers removed from the top protector.
Figure 9:
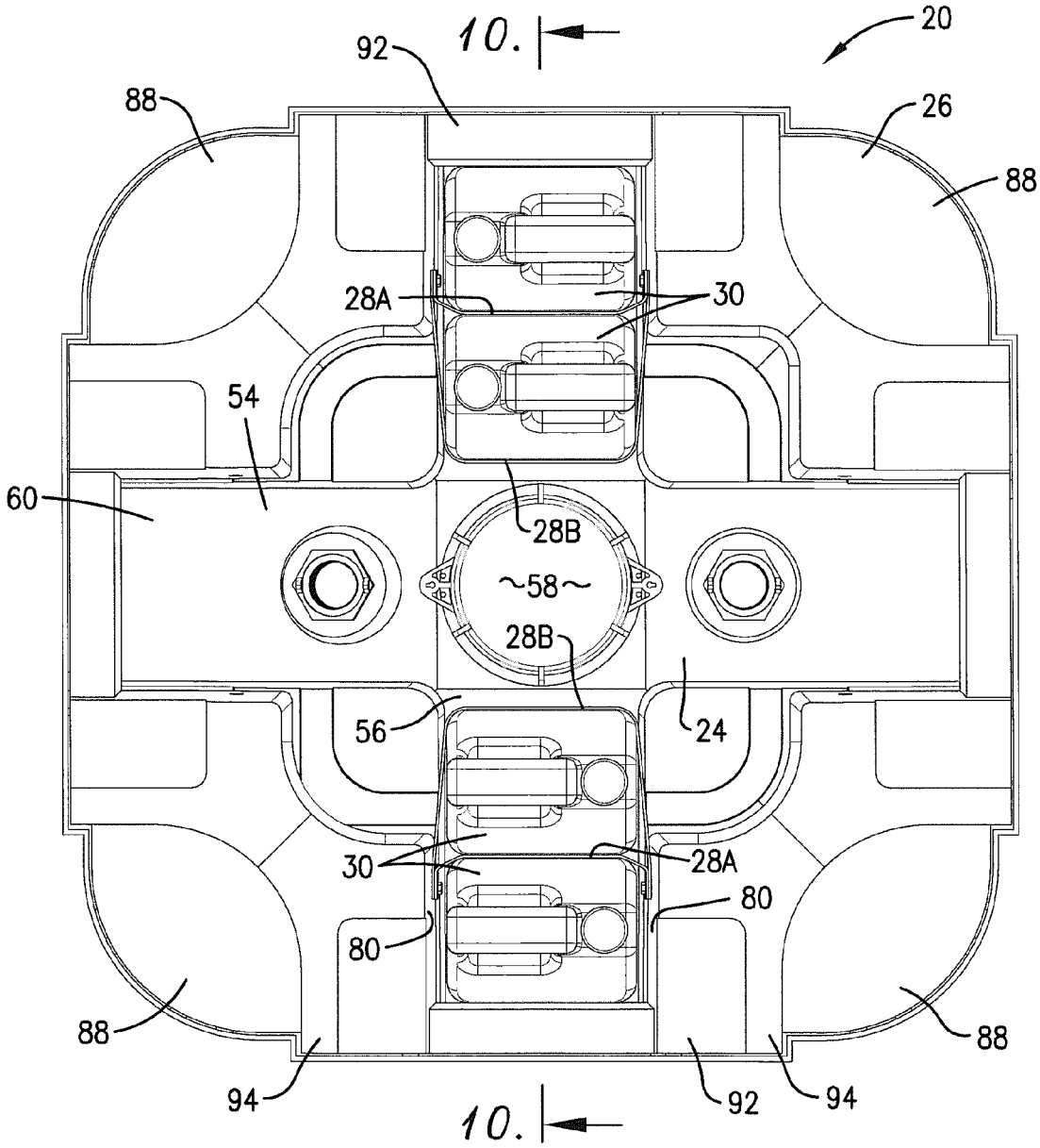
FIG. 9 is a top plan view of the arrangement of FIG. 7, showing the positioning of the secondary containers within the top protector and atop the primary container.
Figure 10:
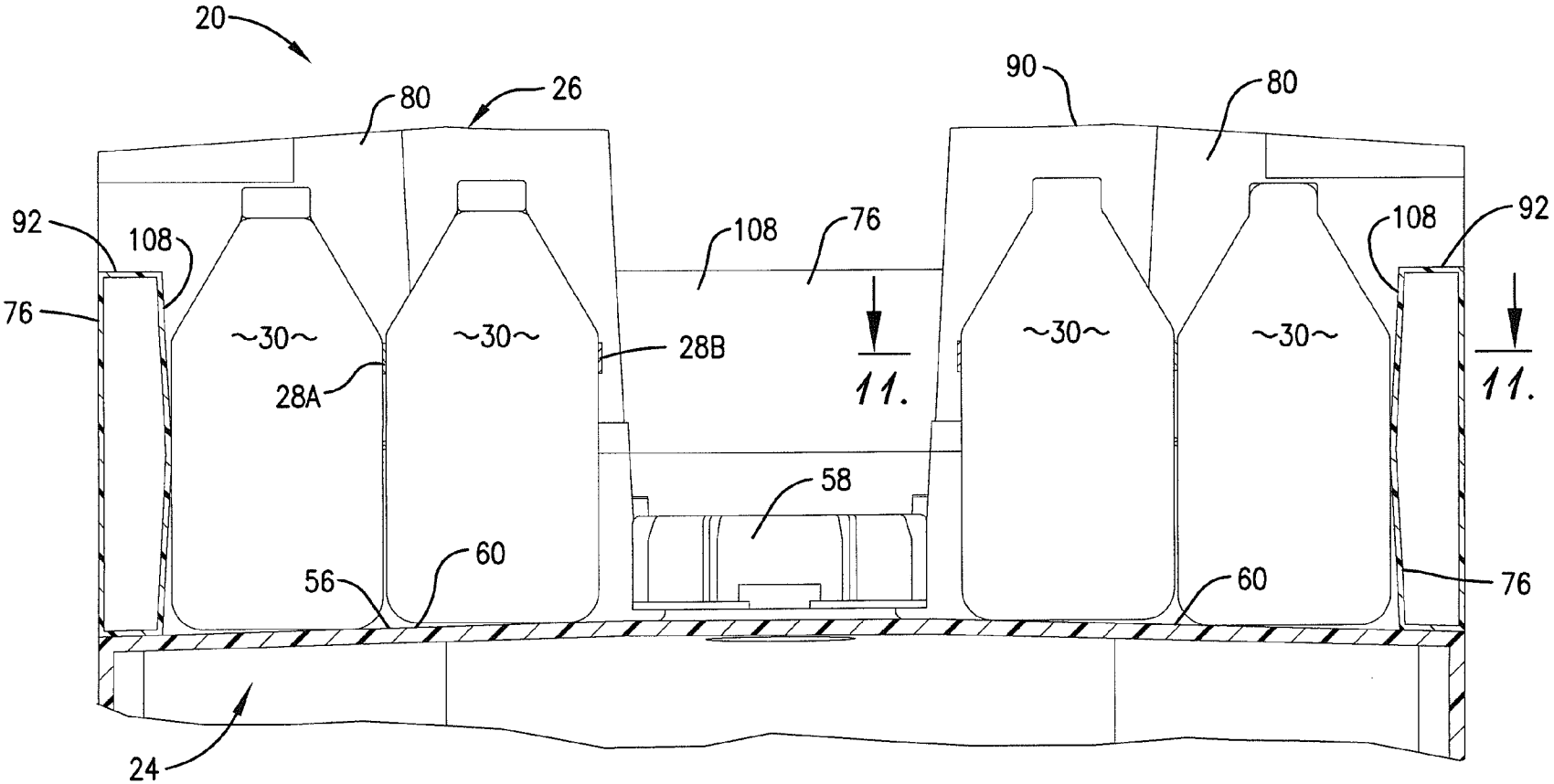
FIG. 10 is an enlarged vertical cross-sectional view taken along line 10-10 of FIG. 9 and similar to FIG. 5, showing each of the retainers holding a plurality of secondary containers.

The base 22, primary container 24 and top protector 26 may be rotationally molded as separate components as is well known to those skilled in the art. Once molded, the retainers 28 are attached to the anchors 106 molded into the corner modules 78 by the bolts 104 as described above. The primary container 24 is inserted into the base 22, and the top protector 26 is mounted atop the primary container 24. It may be appreciated from the foregoing description and the drawings that the lugs 76 are received in the channels 54 and 56 of the primary container, with the corner feet 84 positioned atop the corner shelves 68. When so assembled, the primary container 24 resists lateral movement with respect to the base 22, and the top protector 26 resists lateral movement with respect to the primary container 24. The secondary containers 30 may then sit atop the planar floors of the channels 54 and 56 and thus held in position not only by the channel walls 62 but also by the risers 80. The retainers 28 further resist lateral movement of the secondary containers 30, the secondary containers 30 being held between the bight of the retainer 28 and the interior surface 108 of the lug 76. The top protector 26 not only permits stacking of several systems 20 one atop another, but because rim 90 extends upwardly above the height of each of the secondary containers 30 as shown in FIGS. 5 and 10, protects the secondary containers 30 as well. Furthermore, access may be gained to the central opening of the primary container 24, and removal of the cap 58 can be accomplished without the necessity of removing the top protector 26. The arrangement further permits different arrangements of the secondary containers 30, their removal from the system 20 without the necessity of removing the top protector 26, and the ability to pour their contents into the opening after removal of the cap 58 without removing the top protector.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention. For example, the secondary containers may be bottles, jugs or the like of various sizes, and can include both containers which are substantially rigid as well as containers which are flexible such as bags which can contain liquid or dry ingredients such as those in granular, powder, pellet or other dry forms.

We claim:

1. A protection and containment system for co-packaged containers comprising:

a hollow primary container having a circumscribing upright sidewall and an opening configured for receiving material to be stored in the container;

a top protector complementally configured with the primary container for fitting therewith atop the primary container, said top protector including a side wall and at least a pair of spaced-apart opposed risers extending upwardly from the primary container above the opening and presenting a gap therebetween;

at least one retainer coupled to each of said pair of spaced-apart opposed risers and positioned interiorly of said side wall, said retainer being located and configured for holding a secondary container atop the primary container; and a base complementally configured for receiving and supporting said primary container thereon and configured complemental to said top protector whereby a plurality of protection and containment systems can be stacked;

wherein said risers and side wall of said top protector and said retainer are located and configured to permit nesting of a secondary container in a gap between the risers and adjacent an interior surface of the side wall wherein the primary container includes a bottom wall, a top wall, and wherein the sidewall is configured complemental and in substantial vertical registry with a generally rectangularly configured side wall of the base so as to extend upwardly therefrom when the primary container nests with and is supported by the base, the top wall of the primary container being configured with four corner sections separated by a pair of intersecting channels, each of said channels having a substantially planar floor and a pair of opposed, upright channel walls, wherein each of the corner sections includes a corner shelf and a pair of side shelves, the system further comprising at least one secondary container held by said retainer in the gap between said risers and sized whereby no part of said secondary container extends upwardly beyond a top rim of said top protector, and wherein said side wall of said top protector includes a plurality of downwardly extending lugs sized and configured to be received into channels provided in the primary container with the lugs resting on the planar floors of the primary container.

2. A protection and containment system for co-packaged containers as set forth in claim 1, wherein the primary container is molded of synthetic resin.

3. A protection and containment system for co-packaged containers as set forth in claim 2, wherein the top protector is molded of synthetic resin.

4. A protection and containment system for co-packaged containers as set forth in claim 1, wherein the side wall of top protector substantially in vertical alignment with circumscribing upright sidewall of the primary container.

5. A protection and containment system for co-packaged containers as set forth in claim 4, wherein the top protector is configured to permit access to the opening of the primary container.

6. A protection and containment system for co-packaged containers as set forth in claim 1, wherein the retainer is coupled to the risers by threaded fasteners.

7. A protection and containment system for co-packaged containers as set forth in claim 6, wherein said risers include metal anchors molded into the risers, and wherein the retainer is coupled to the risers by threading the threaded fasteners into the anchors.

8. A protection and containment system for co-packaged containers as set forth in claim 6, wherein the retainer includes a metal strap.

9. A protection and containment system for co-packaged containers as set forth in claim 6, wherein the retainer includes a nylon strap.

10. A protection and containment system for co-packaged containers as set forth in claim 6, wherein the retainer is of an elastomeric material.

11. A protection and containment system for co-packaged containers as set forth in claim 1, wherein the top protector includes a plurality of corner modules, said risers being provided as part of said corner modules wherein two risers of any corner module are generally perpendicular to one another and lie generally parallel to and opposite one riser of an adjacent corner module, the corner modules being connected by said lugs, said lugs including a part of said interior surface of said side wall.

12. A protection and containment system for co-packaged containers as set forth in claim 11, wherein each of said corner modules includes a corner foot sized and configured to rest atop a corresponding corner shelf of the primary container.

13. A protection and containment system for co-packaged containers as set forth in claim 12, wherein each of said corner modules includes a top surface which includes a substantially planar corner deck, and wherein said base includes a plurality of legs, the legs being sized and configured whereby the legs of the base of one corner system may each rest atop a corner deck of a top protector of a second protection and containment system for co-packaged containers when two such systems are stacked one atop the other.

14. A protection and containment system for co-packaged containers as set forth in claim 13, wherein said top surface also includes an upwardly extending rim which extends upwardly above said corner deck and above a top edge of the lugs.

15. A protection and containment system for co-packaged containers as set forth in claim 14, wherein first and second retainers are provided, each connected by a threaded fastener to a respective one of said anchors, and wherein said second retainer having a greater length extending between anchors than said first retainer.

* * * * *